United States Patent [19]

Schadt, III

[11] 4,383,023

[45] May 10, 1983

[54] DYE MORDANTING DEVELOPMENT

[75] Inventor: Frank L. Schadt, III, Wilmington, Del.

[73] Assignee: E. I. Du Pont de Nemours and Company, Wilmington, Del.

[21] Appl. No.: 307,647

[22] Filed: Oct. 1, 1981

[51] Int. Cl.[3] ..... G03C 5/30

[52] U.S. Cl. ..... 430/264; 430/213; 430/371; 430/435; 430/441; 430/442; 430/484; 430/485

[58] Field of Search ..... 430/213, 224, 371, 435, 430/405, 441, 442, 367, 484, 485, 370, 264

[56] References Cited

U.S. PATENT DOCUMENTS

| | | | |
|---|---|---|---|
| 2,529,922 | 11/1950 | Dean | 430/264 |
| 3,019,108 | 1/1962 | Dershowitz | 430/485 |
| 3,590,692 | 7/1971 | Bloom | 430/213 |
| 3,729,314 | 4/1973 | Haas | 430/371 |
| 3,887,563 | 6/1975 | Bloom | 96/96 |
| 4,294,915 | 10/1981 | Idelson | 430/485 |

OTHER PUBLICATIONS

Rul et al., Journal of Photo Science, vol. 15, 1967 Jul., Aug., pp. 174–180.

*Primary Examiner*—Mary F. Downey

[57] ABSTRACT

A gelatino-silver halide film is exposed and then developed with a tanning developer bearing a positively or negatively charged substituent, e.g., a quaternary amine-substituted hydroquinone, to produce a charged matrix in the gelatin. To enhance the image the film is then processed to mordant an oppositely charged species, e.g., an anionic dye, to the charged matrix.

8 Claims, No Drawings

DYE MORDANTING DEVELOPMENT

BACKGROUND OF THE INVENTION

1. Field of the Invention

The present invention relates to photographic silver halide films which undergo tanning development, and in particular deals with photographic silver halide films of lowered silver halide content in which the silver density is enhanced by dye mordanting development.

2. Related Prior Art

When gelatin, or leather, is tanned cross-links are formed between the long protein molecules, which are thus rendered insoluble and mechanically durable. On this principle, the function of a tanning developer in the field of photography is to develop the latent image in an exposed gelatino-silver halide emulsion under conditions such that the oxidation products from the developer form bridges between gelatin molecules in the vicinity thereof.

There is a close analogy between tanning development and color development, and in some instances an apparent identity. Image production by the reaction of a positively charged developer oxidation product and a negatively charged color coupler which unite to form a dyestuff is well known in color photography, and in some cases is accompanied by tanning of the gelatin in image areas. Modifications of the color production process in diffusion transfer systems has involved mordanting an acid dye image in a layer as in Whitmore U.S. Pat. No. 3,271,148. Other patents involving developer and dye combinations in photographic films are U.S. Pat. Nos. 3,887,563; 3,817,751; 3,728,113; 3,622,629; 3,590,692; and 3,243,294.

A common characteristic of these prior art teachings is that a special film is required, the chemical structure of which participates in the reaction to produce the desired image density. They do not contemplate attaining such density with conventional films which dispense with special additions to the silver halide emulsion. In this respect the present invention departs from the prior art.

SUMMARY OF THE INVENTION

The object of the instant invention is to enable the silver halide coating weight of a conventional silver halide film to be lowered. This is achieved by providing a process in which a photographic film comprising a support bearing a photosensitive gelatino-silver halide emulsion is imagewise exposed and thereafter developed with a positively or negatively charged tanning developer to produce a charged matrix in the gelatin, characterized in that the developed film is then processed to mordant an oppositely charged species to the charged matrix.

To do this a gelatino-silver halide emulsion is coated on a support at a coating weight which results in insufficient silver density upon tanning development, but in subsequent processing of the developer film the silver density is enhanced by contact with an intensifying reagent, such as a dye, which mordants to charged areas of the film in imagewise correspondence with the silver. Those charged areas are created during the development step when the exposed gelatino-silver halide emulsion is developed in a developer comprising a quaternary amine-substituted hydroquinone, which generates positive charges imagewise in the gelatin matrix of the emulsion via tanning development. Anionic dyes are thereafter mordanted by these positive charges, and this enhances silver density. It is possible to mordant the charged matrix with an oppositely charged species other than a dye, e.g., a color coupler, a noncolored image intensifying agent, a hardener or crosslinking agent, and surfactant. Thereby a further processing or washoff step can produce a dye image, relief image, printing plate, or planographic printing plate.

The present invention can be summarized as a process for supplementing a silver image formed by exposure and development of a photosensitive gelatino-silver halide emulsion film, comprising the steps of:

(1) exposing the film imagewise, (2) developing the film in a developer solution containing a tanning developer bearing a positive or negatively charged substituent, to produce a positive or negative charge in the gelatin matrix, and (3) processing the developed film in a solution containing an oppositely charged species which mordants to the charged matrix, whereby the developed silver image and mordanted matrix function in combination to produce a useful image.

DETAILED DESCRIPTION OF THE INVENTION

Gelatino-silver halide emulsions useful for the practice of the present invention are well known in the art. Silver chloride, silver bromide, silver chlorobromide, and silver iodobromide and trihalide emulsions may be coated on suitable supports such as paper, films of cellulose acetate, polyolefins, a polyethylene terephthalate; glass, metals, etc. Both sensitized and unsensitized emulsions are useful. A wide range of photographic adducts may be employed with such emulsions such as coating aids, antifoggants, stabilizers, sensitizing dyes, covering power polymers, synthetic binders, and hardeners.

Developers suitable for the present invention include hydroquinone, substituted hydroquinone, pyrogallol, catechol, and other tanning developers as described by A. G. Tull, J. Photogr. Sci., 11, 1 (1963) "Tanning Development and its Application to Dye Transfer Images". While quaternary amine substituted tanning developers are preferred, phosphonium and sulfonate substituents would also be useful.

A particularly useful developer has the formula:

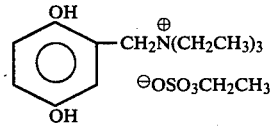

The present invention can employ a variety of developer formulations in which hydroquinone or N-methyl-p-aminophenol sulphate (metol) would be replaced by a dye mordanting developer as the primary developing agent. For example the following developer formulation represents a preferred embodiment of the present invention representing the type of developer which would normally contain hydroquinone and which is used in automatic processing machines:

| | |
|---|---|
| Dye mordanting developer (2-triethylammoniummethyl) hydroquinone ethyl sulphate | 24 g |
| Phenidone | 0.75 g |

-continued

| | |
|---|---|
| (1-phenyl-3-pyrazolidone) | |
| Sodium metaborate | 33 g |
| Sodium hydroxide | 19 g |
| Potassium bromide | 10 g |
| 6-Nitrobenzimidazole | 0.5 g |
| E.D.T.A. (disodium salt) | 3.5 g |
| Polyethylene glycol 200 | 0.2 ml |
| Gluteraldehyde | 17 g |
| Water to make | 1 liter |

It is not intended that this formulation be considered limiting on the scope of the present invention. Persons skilled in the art will realize that a wide range of developer compositions are known which use hydroquinone, phenidone and metol. In addition, it is known to vary the activity of a developer by varying the ingredients and their balance; for example benzotriazole may be used instead of or in combination with 6-nitrobenzimidazole, sodium carbonate may be used instead of sodium metaborate, chelating agents may be used other than E.D.T.A. (ethylene diamine tetraacetic acid), and aldehyde hardeners other than glutaraldehyde may be used. As can be appreciated, differences in chemical activity mean that comparable ingredients cannot always be substituted on a weight for weight basis.

The present invention is believed to take place by the following reactions. QUAT represents a positively charged quaternary amine group attached to hydroquinone, in this case by an alkyl group. Gel represents a polypeptide gelatin polymer chain which is part of the silver halide emulsion binder. AgX represents silver halide grain which is being developed to silver metal by the developer. Dye represents the molecular structure of a negatively charged spectral dye.

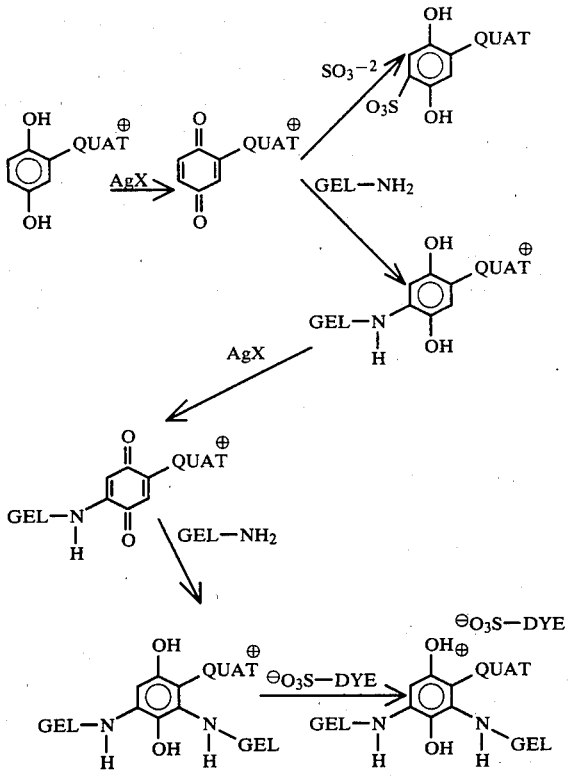

As shown there is a competing reaction with the sulfite ion. However, even when sulfite is present as a developer stabilizer, the gelatin crosslinking reaction occurs. Since the semiquinone is formed in close proxmity to the developing silver halide grain, the gelatin linkage also occurs in close proximity. The second gelatin linkage, in cases where it occurs, must also take place at the same location. Thus the charged QUAT is localized where the silver halide grain has been converted to silver metal to yield image. When the negatively charged dye is added, the charge is neutralized by electrical attraction and the dye is localized or mordanted to provide additional image density at the same location. Thus if the initial silver density was below a level required to give a full utility image, the dye mordanting step can provide additional density to obtain a final useful image by enhancement.

If the QUAT is replaced by a negatively charged group such as sulfonate, and a positively charged species is used instead of the dye shown, then the same reaction scheme would similarly localize or mordant the positive species in proximity with the developed silver image. Thus in its broadest concept the present invention allows producing either a positive or negative charge on the matrix within a silver halide film, which corresponds to the silver image produced by development. Once formed, this matrix can accept a wide variety of oppositely charged species. The oppositely charged species may be permanently mordanted as in the case of enhancement of the silver image, or the oppositely charged species would be only temporarily mordanted. For example when the chemical or physical properties are suitably altered within the image areas, a conventional gelatino-silver halide film can be converted into a washoff film or printing plate. In addition, since the mordanting is based on coulombic attraction, a stronger coulombic force could cause the charged species to be transferred from the charged matrix to a receiver sheet as a means of producing a transfer image. The charged species can be a surfactant, hardener, color coupler, dye, or bleach retardant.

Anionic dyes useful for enhancing the silver image are blues and blacks which do not give undesirable stain. Surfactants, plasticizers and swelling agents may be used in conjunction with these dyes during the processing step to aid dye diffusion and mordanting. The temperature of the processing solution may be varied to optimize the mordanting step.

Dyes include CAPRACYL BLACK BGL C.I. Acid Black No. 107, available from Crompton and Knowles, PONTACRYL WOOL Blue BL C.I. Acid Blue No. 59, available from Organic Chemical Corporation, and Acidol Black M-SRL C.I. Acid Black No. 194, available from BASF. Gelatin swelling agents include urea, ammonium thiocyanate, and benzyl alcohol. Plasticizers include glycerin, and triethylene glycol diacetate. Surfactants can assist in the dye mordanting process, such as ZONYL FSA, an anionic fluorocarbon available from E. I. du Pont de Nemours and Company.

The process of the present invention is further illustrated by the following examples.

EXAMPLE 1

(1) Synthesis of 2-(triethylammoniummethyl)hydroquinone ethyl sulfate; Aminomethylation of p-methoxyphenol To 372 g (3.0 mole) of p-methoxyphenol suspended in 750 ml distilled water at a temperature of ≦10° C. and under a constant nitrogen atmosphere was added dropwise 219 g (3.47 mole) of diethylamine. The mixture was cooled to 0° to 5° C., and 258 ml of a 35% aqueous formaldehyde solution was added dropwise. After the addition the temperature was raised to 20° C., and the brown oil which formed was separated and washed thrice with 375 ml of tap water. The oil was dissolved in ethyl ether and dried overnight over anhydrous $Na_2SO_4$. Dry HCl was bubbled through the solution to yield a viscous oil, which was washed thrice with 1800 ml portions of ethyl ether to yield a tan granular solid. This was filtered, and dried under pump vacuum to yield 400 g of the hydrochloric acid salt. The yield was 54.2% and the product had a melting point of 128°–131° C. The literature value for melting point is 132° C.

(2) 2-(N,N-diethylaminomethyl)hydroquinone hydrobromide

A 112 g (0.456 mole) portion of the aforesaid hydrochloric acid salt was dissolved in 840 ml 48% aqueous HBr. The solution was boiled under a nitrogen atmosphere for six hours, then concentrated to dryness under pump vacuum, and triturated with acetone to give 70 g of a tan powder. This was recrystallized from 5/1 acetonitrile/ether to give 63 g of white fluffy crystals at a yield of 50.3% and melting point 126°–129° C. The literature value is 130° C.

(3) 2-(N,N-diethylaminomethyl)hydroquinone

A 60 g (0.22 mole) portion of the above-described 2-(N,N-diethylaminomethyl) hydroquinone hydrobromide was dissolved in 100 ml distilled water. A solution of 19 g of $NaHCO_3$ in 150 ml distilled water was added to generate the free amine. It was quickly extracted with four 300 ml portions of ethyl ether, and the extracts were dried over anhydrous $Na_2SO_4$. The ether solution was filtered, and evaporated to a slurry which was filtered to give 18 g of white cubic crystals with a melting point of 113.5°–114.5° C. in comparison with the literature value of 113° C. Further extraction of the aqueous layer yielded 13.5 g additional material for 72.5% total yield.

For the structure $C_{11}H_{17}NO_2$: Calculated values: C-67.66, H-8.78, N-7.18; Experimental values: C-67.71, H-8.72, N-7.02.

(4) 2-(triethylammoniummethyl)hydroquinone ethyl sulfate

A 34 g (0.174 mole) portion of the free amine described above was dispersed in 1040 ml fresh toluene by stirring magnetically under a nitrogen atmosphere. With the stirred amine held at reflux conditions, the amine dissolved and 28 g (0.182 mole) diethyl sulfate in 300 ml fresh toluene was added dropwise to the refluxing solution of the amine in toluene. After refluxing for 52 hours under nitrogen, separation of an oily product was achieved. The solution was cooled to room temperature under nitrogen. The toluene was removed by decantation. The viscous brown oil was dried under pump vacuum. A clear, light yellow oil was obtained by extracting the reaction product with distilled water. Thin layer chromatography indicated the presence of other products, but the NMR spectrum was consistent with the final structure and showed no starting material. The presence of hydroquinone functionality was indicated by the reduction of aqueous $AgNO_3$ in basic solution.

For the structure $C_{15}H_{27}NO_6S$:

| | |
|---|---|
| Calculated value | S - 9.17 |
| Experimental value | S - 9.90 |
| Literature value J. M. Willems, Photo Sci. Eng., 4, p. 101 (1960) | S - 9.43 |

The resulting compound was identified as DMD for dye mordanting developer.

EXAMPLE 2

A gold- and sulfur-sensitized gelatinoiodobromide (1.2%) emulsion was coated without hardener on a photographic grade polyester support at a silver bromide coating weight of 77 mg/dm$^2$. When samples of this film were exposed and processed for 90 sec. at room temperature in a continuous tone developer composition comprising hydroquinone as the major developer, the gradient and maximum density were below the level which would have been achieved had the emulsion been coated at its optimum silver coating weight of 100 mg/dm$^2$.

A continuous tone developer was prepared as above except that DMD as prepared in Example 1 was substituted for hydroquinone on an equimolar basis.

A sample of the 77 mg/dm$^2$ film was exposed as before, but was then developed in the developer containing DMD for 90 sec. at room temperature. Directly following this silver development and fixing and washing steps, a further processing step was carried out at room temperature using a 4% aqueous solution of CAPRACYL BLACK BGL containing 4% urea.

The process of the present invention produced a 23% increase in optical density over the undyed silver image, after correcting for dye-gelatin stain. This example represents the best mode of the present invention.

EXAMPLE 3

Example 2 was repeated except that urea was omitted from the dye solution. As a result a 3–17% increase in optical density was observed.

EXAMPLE 4

Different dyes were compared in the process of Example 3, except that a hardened overcoated film at silver bromide coating weight of 60 mg/dm$^2$ was used and was air-dried before treating with dye solutions at 45°–50° C. Optical density increases of 19, 10, and 6%, corrected as in Example 2, were observed when using CAPRACYL BLACK BGL, PONTACYL WOOL Blue BL, and Acidol Black M-SRL.

EXAMPLE 5

When the dyeing process of Example 4 was carried out at room temperature instead of 45° C., the optical density improvement was substantially reduced or eliminated.

EXAMPLE 6

Urea, triethylene glycol diacetate, dimethyl sulfoxide, and combinations thereof with ZONYL FSA were tested in various dye solutions in the process of Exs. 2 and 5 (water presoak) with a hardened, overcoated film of 110 mg/dm$^2$ AgBr coating weight. 1 to 7% increases in optical density were obtained relative to those obtained using solutions containing the dye alone.

EXAMPLE 7

When the film of Example 6, while wet from photographic processing with developer containing DMD as in Example 2, was treated in an aqueous bath of the sodium salt of 1-phenyl-5-mercaptotetrazole at 22°–35° C., 5–15% density increases were obtained, compared to those where the film was similarly processed in a control developer containing hydroquinone in place of of DMD. This example shows that a noncolored species can enhance the silver image by the process of this invention. Control experiments showed that dye enhancements were not significantly increased by replacing DMD with hydroquinone and half an equimolar amount of tetraethylammonium nitrate, a cationic species incapable of reacting with gelatin by the present process.

I claim:

1. A process in which a photographic film comprising a support bearing a photosensitive gelatino-silver halide emulsion is imagewise exposed and thereafter developed with a tanning developer bearing a positively or negatively charged substituent to produce a charged matrix in the gelatin, characterized in that the developed film is then processed to mordant an oppositely charged species to the charged matrix.

2. A process for supplementing a silver image formed by exposure and development of a photosensitive gelatino-silver halide emulsion film comprising the steps of:

(1) exposing the film imagewise, (2) developing the film in a developer solution containing a tanning developer bearing a positive or negative charge to produce a positive or negative charge in the gelatin matrix, and (3) processing the developed film in a solution containing an oppositely charged species which mordants to the charged matrix, whereby the developed silver image and mordanted matrix function in combination to produce a useful image.

3. The process of claim 2 wherein the oppositely charged species is selected from the group consisting of a dye, a color coupler, a noncolored image intensifying agent, a hardener or cross-linking agent, and a surfactant.

4. The process of claim 2 wherein the tanning developer is a quaternary amine-substituted hydroquinone, and subsequent mordanting is effected by contacting the developed film with a solution containing an anionic dye.

5. The process of claim 4 wherein the tanning developer is 2-(triethylammonium methyl)hydroquinone ethyl sulfate.

6. The process of claim 5 wherein the solution containing an anionic dye also contains urea.

7. A process wherein a gelatino-silver halide emulsion coated on a support is imagewise exposed, and the exposed emulsion is developed in a developer comprising a quaternary amine-substituted hydroquinone, which generates positive charges imagewise in the gelatin matrix of the emulsion via tanning development, and an anionic dye is thereafter mordanted to the charged areas in imagewise correspondence with the silver.

8. The process of claim 7 wherein the tanning developer is 2-(triethylammonium methyl)hydroquinone ethyl sulfate.

* * * * *